United States Patent [19]

van Esdonk et al.

[11] Patent Number: 4,671,777

[45] Date of Patent: Jun. 9, 1987

[54] METHOD OF MANUFACTURING A DISPENSER CATHODE AND THE USE OF THE METHOD

[75] Inventors: Johannes van Esdonk; Henricus A. M. van Hal; Josef J. van Lith, all of Eindhoven, Netherlands

[73] Assignee: U.S. Philips Corporation, New York, N.Y.

[21] Appl. No.: 855,233

[22] Filed: Apr. 24, 1986

[30] Foreign Application Priority Data

May 3, 1985 [NL] Netherlands ..... 8501257

[51] Int. Cl.[4] ..... H01J 9/04

[52] U.S. Cl. ..... 445/51; 313/346 DC

[58] Field of Search ..... 445/50, 51; 313/346 DC

[56] References Cited

U.S. PATENT DOCUMENTS

| | | | |
|---|---|---|---|
| 3,113,370 | 12/1963 | Lerman | 445/51 |
| 3,458,913 | 8/1969 | Schmidt | 445/51 |
| 3,919,751 | 11/1975 | Buescher et al. | 445/51 |

*Primary Examiner*—Kenneth J. Ramsey

*Attorney, Agent, or Firm*—Norman N. Spain

[57] ABSTRACT

The invention relates to a method of manufacturing a dispenser cathode having a porous tungsten body, in which a metal oxide is provided in the body and the body is impregnated with barium. Good results as regards life and resistance to ion bombardment are obtained if the comparatively cheap oxides of gallium and indium are used.

8 Claims, 2 Drawing Figures

METHOD OF MANUFACTURING A DISPENSER CATHODE AND THE USE OF THE METHOD

BACKGROUND OF THE INVENTION

The invention relates to a method of manufacturing a dispenser cathode comprising a porous dispenser body having an emissive surface which is destined for emission during operation, in which, in a stage of the formation of the dispenser body a tungsten powder compact which comprises an oxide of a metal at least in a surface layer is provided, the compact being subjected to an impregnation treatment with a barium-containing material to provide pores present in the compact with the metal oxide and barium containing compound for dispensing. during operation, the metal and the barium to the emissive surface.

A method of the type mentioned in the opening paragraph is disclosed in Netherlands patent application No. 8201371 corresponding to U.S. Pat. No. 4,625,142.

In this known method scandium is used as the metal and scandium oxide is provided in a surface layer of the powder volume from which the dispenser body is to be compacted. The powder volume is compacted and sintered, and the sintered compact is impregnated via a scandium oxide-free surface.

In a modified embodiment of the known method, scandium oxide is deposited on a surface of a sintered tungsten body, the body is after-firedand impregnated via a scandium oxide-free surface.

Scandium oxide may also be deposited on a body of compressed tungsten powder and the body may then be sintered and impregnated.

Although good results are obtained with scandium oxide, this material has the disadvantage of being expensive.

SUMMARY OF THE INVENTION

One of the objects of the invention is to avoid this disadvantage.

Therefore, according to the invention, the method mentioned in the opening paragraph is characterized in that at least one of the member of the group consisting of gallium and indium is used as the metal.

Gallium and indium are comparatively cheap and turn out to provide food dispenser cathodes.

DETAILED DESCRIPTION OF THE INVENTION

If the indium- or gallium oxide is provided in a surface layer of the dispenser body, a content of metal oxide from 2 to 20% by weight calculated on metal oxide + tungsten, in particular approximately 10% by weight, is preferably used.

The said contents give particularly good results, for example, an emission of 70–80 A/cm$^2$ at a temperature of 950° C. and a life of the cathode at of least 10,000 hours, while moreover the cathode withstands very well an ion bombardment.

A first embodiment of the method according to the invention is characterized in that a powder layer of indium oxide and/or gallium oxide and tungsten is provided on top of a volume of tungsten powder, after which the whole is compressed and sintered and impregnated via a metal oxide-free surface.

Particularly good results are obtained when an indium- and/or gallium oxide-containing layer is used which at the surface destined for emission extends over a thickness of from 20 to 100 μm.

A second embodiment of the method according to the invention is characterized in that a tungsten compact is provided which comprises the indium oxide and/or gallium oxide mixed through the whole tungsten compact, a content of metal oxide from 0.5 to 5% by weight, in particular approximately 2% by weight, being used.

It has been found that when gallium oxide and/or indium oxide is incorporated in the whole volume of tungsten powder (matrix), the resulting body after compaction and sintering absorbs better than when scandium oxide is used.

The method according to the invention is particularly suitable for the manufacture of, for example, L-cathodes.

Figure 1:
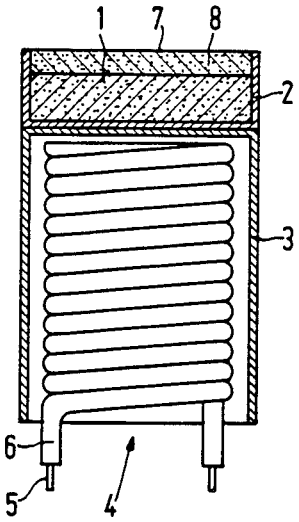
FIGS. 1 and 2 are each diagrammatic longitudinal sections views of parts of dispenser cathodes of the invention.
Figure 2:
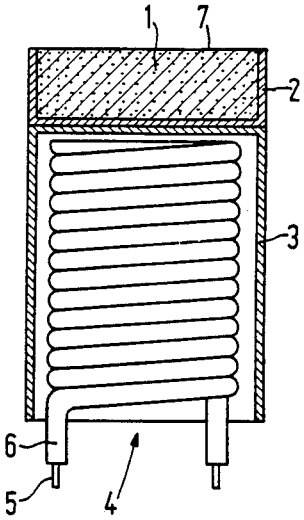

Some embodiments of the method according to the invention will now be described with reference to a few examples and the accompanying drawing in which FIG. 1 is a diagrammatic longitudinal sectional view of a part of a first dispenser cathode manufactured by means of the method according to the invention, and FIG. 2 is a diagrammatic longitudinal sectional view of a part of a second dispenser cathode again manufactured by means of the method according to the invention.

EXAMPLE 1

A dispenser body 1, 8 (see FIG. 1 is compressed from a volume of tungsten powder, on top of which before compression a 0.2 mm thick layer of a mixture of 90% by weight of tungsten powder and 10% by weight of gallium oxide or indium oxide has been provided. After compressing and sintering at 1500° for 1 hour the dispenser body 1,8 consists of a 0.7 mm thick porous tungsten layer 1 having a density of approximately 75% and an approximately 0.2 mm thick gallium oxide- or indium oxide-containing porous tungsten layer 8 having a density of approximately 83%.

The density of known dispenser bodies often is more than 83%. As compared with this, the body of a dispenser cathode manufactured by means of the method according to the invention can absorb more impregnant (emitter material).

The dispenser body is then impregnated in a conventional manner with barium-calcium-aluminate (for example, $(BaO)_5(Al_2O_3)_2(CaO)_3$ or $(BaO)_4Al_2O_3CaO$ via a surface not coated by layer 8.

The impregnated dispenser body is then pressed into a holder 2 and welded to a cathode shank 3.

A coiled cathode filament consisting of a helioally wound metal core 5 and an aluminum oxide insulation layer 6 is present in the cathode shank 3. Because a oomparatively high concentration of gallium or indium is present at the surface 7 destined for emission, an emission of 70–80 A/cm$^2$ at 950° C. is obtained at a pulse load of 1,000 Volts in a diode having a cathode-anode spacing of 0.3 mm. The life and the resistance to ion bombardment are excellent.

EXAMPLE 2

The manufacture of the dispenser cathode to be described here is generally analogous to that of Example 1, with the difference that the gallium- or indium oxide is mixed with the whole of the tungsten powder in a content of 0.5–5%, for example 2%, by weight. As a result of this the layer 8 of FIG. 1 is absent in FIG. 2.

Impreganation is carried out in the conventional manner via a surface of the dispenser body not destined for emission.

In this case the same good properties are found as in Example 1.

The method according to the invention is not restricted to the examples described. The cathode to be manufactured may, for example, have the shape of a hollow cylinder, or be an L-cathode.

It will be obvious that many variations are possible to those skilled in the art without departing from the scope of the invention.

What is claimed is:

1. A method of manufacturing a dispenser cathode comprising a porous dispenser body having an emissive surface from which emission occurs during operation, in which method during the formation of the dispenser body, a tungsten powder compact is provided which compact comprises an oxide of a metal at least in a surface layer, the compact being subjected to an impregnation treatment with a barium-containing material to provide pores, present in the compact, with the metal oxide and the barium-containing compound for dispensing, during operation, the metal and the barium to the emissive surface of said body, characterized in that at least one of the members of the group consisting of gallium and indium is used as the metal.

2. A method as claimed in claim 1, characterized in that a tungsten powder compact is provided which contains the metal oxide in a surface layer, a content of metal oxide from 2 to 20% by weight calculated on metal oxide plus tungsten being used.

3. A method as claimed in claim 2, characterized in that a content of metal oxide of approximately 10% by weight is used.

4. A method as claimed in claim 2 characterized in that a powder layer of the metal oxide and tungsten is provided on top of a volume of tungsten powder, the whole being compressed and sintered and the sintered compact being impreganted via a metal oxide-free surface.

5. A method as claimed in claim 2, characterized in that a metal oxide-containing layer is used which at the emissive surface has a thickness of 20 to 100 μm. a thickness of 20 to 100 μm.

6. A method as olaimed in claim 1, characterized in that a tungsten powder compact is provided which comprises the metal oxide mixed through the whole compact, a content of metal oxide from 0.5 to 5% by weight being used.

7. A method as claimed in claim 6, characterized in that a content of metal oxide of approximately 2% by weight is used.

8. The use of the method as claimed in claim 1 in the manufacture of an L-cathode.

* * * * *